US010113394B2

(12) United States Patent
Hekelaar

(10) Patent No.: US 10,113,394 B2
(45) Date of Patent: Oct. 30, 2018

(54) MULTI-STAGE FLOW DEVICE

(71) Applicant: Smith International, Inc., Houston, TX (US)

(72) Inventor: Stephen J. Hekelaar, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 399 days.

(21) Appl. No.: 14/618,176

(22) Filed: Feb. 10, 2015

(65) Prior Publication Data

US 2015/0226031 A1 Aug. 13, 2015

Related U.S. Application Data

(60) Provisional application No. 61/938,356, filed on Feb. 11, 2014.

(51) Int. Cl.

| | |
|---|---|
| ***E21B 34/14*** | (2006.01) |
| ***E21B 34/10*** | (2006.01) |
| ***E21B 34/06*** | (2006.01) |
| ***E21B 29/00*** | (2006.01) |
| ***E21B 31/20*** | (2006.01) |
| ***E21B 31/107*** | (2006.01) |

(Continued)

(52) U.S. Cl.

CPC ..... *E21B 34/14* (2013.01); *E21B 21/103* (2013.01); *E21B 29/002* (2013.01); *E21B 31/107* (2013.01); *E21B 31/20* (2013.01); *E21B 34/063* (2013.01); *E21B 34/10* (2013.01); *E21B 2034/007* (2013.01)

(58) Field of Classification Search

CPC ..... E21B 34/10; E21B 21/103; E21B 31/107; E21B 29/002; E21B 34/063; E21B 31/20; E21B 2034/004; E21B 21/10; E21B 34/14; E21B 29/00

See application file for complete search history.

(56) References Cited

U.S. PATENT DOCUMENTS

| | | | |
|---|---|---|---|
| 4,706,745 | A | 11/1987 | Bishop et al. |
| 4,969,514 | A | 11/1990 | Morris et al. |
| 5,253,710 | A | 10/1993 | Carter et al. |

(Continued)

FOREIGN PATENT DOCUMENTS

WO 2013016822 A1 2/2013

OTHER PUBLICATIONS

International Preliminary Report on Patentability issued in related PCT application PCT/US2015/015418 dated Aug. 25, 2016, 13 pages.

(Continued)

*Primary Examiner* — Brad Harcourt

(57) ABSTRACT

A multi-stage flow sub usable in wellbore operations provides for flow of fluid from a tool string to a wellbore annulus, and may provide for one or more of controlling wellbore pressure during a tool operation, or preventing stripping of wet string. The multi-stage flow sub may include a housing having an axial bore and at least one flow passage. A sleeve within the housing may have an axial bore, a shoulder acting as a ball seat, and first and second axially offset flow passages. A first burst disc may be in fluid communication with the first flow passage, and a second burst disc may be in fluid communication with the second flow passage, the second burst disc having a higher burst pressure than the first burst disc.

19 Claims, 10 Drawing Sheets

(51) Int. Cl.
*E21B 21/10* (2006.01)
*E21B 34/00* (2006.01)

(56) References Cited

U.S. PATENT DOCUMENTS 6,305,467 B1* 10/2001 Connell ..... E21B 21/103 166/64
7,762,330 B2 7/2010 Saylor, III et al.
8,122,960 B2 2/2012 MacDonald et al.
8,602,101 B2 12/2013 Gibson et al.
2006/0243455 A1* 11/2006 Telfer ..... E21B 21/103 166/386
2007/0017679 A1 1/2007 Wolf et al.
2009/0044949 A1 2/2009 King et al.
2011/0203800 A1* 8/2011 Tinker ..... E21B 34/14 166/318
2013/0168087 A1 7/2013 Linklater et al.
2013/0233549 A1* 9/2013 Boswell ..... E21B 33/14 166/285
2014/0027117 A1* 1/2014 Hekelaar ..... E21B 43/112 166/297
2014/0116721 A1* 5/2014 Hofman ..... E21B 33/00 166/373
2014/0158432 A1* 6/2014 Simpson ..... E21B 17/1057 175/73
2015/0000920 A1* 1/2015 Harris ..... E21B 23/004 166/308.1
2015/0083497 A1* 3/2015 Mageren ..... E21B 7/28 175/57

OTHER PUBLICATIONS

International Search Report and Written Opinion issued in PCT/US2015/015418 dated Jun. 3, 2015; 16 pages.
Notification of Transmittal of the International Search Report and the Written Opinion of the International Searching Authority in International Applicatino No. PCT/US2013/051838, dated Oct. 10, 2013 (10 pages).

* cited by examiner

MULTI-STAGE FLOW DEVICE

CROSS-REFERENCE TO RELATED APPLICATIONS

This application claims the benefit of, and priority to, U.S. Patent Application Ser. No. 61/938,356, filed Feb. 11, 2014 and titled "Cutting and Removing Casings from Wellbores," which application is expressly incorporated herein by this reference in its entirety.

BACKGROUND

In oil and gas exploration and development operations, a wellbore may have a casing installed to, for example, provide structural integrity to the wellbore, or to isolate the interior wellbore from the surrounding formation. For later slot recovery, sidetracking, abandonment, and other operations, portions of the casing may be removed. Casing removal may be performed by cutting the casing and pulling the cut casing to the surface to remove the severed portion.

In the example of slot recovery, a new well may be constructed with new barriers from a previously used slot while shutting off communication with an old reservoir. Cutting and pulling casing may be restricted due to cement behind production casing or barite settling from drilling fluid in the production casing annulus. Such slot recovery operations may thus result in the cutting and removal of multiple sections of casing from a wellbore. Because slot recovery operations often involve cutting a casing segment in a first trip and pulling the cut casing in a second trip, such operations are often time consuming and expensive.

Certain apparatus and techniques for extraction of well casing use multiple trips to move cutting and extracting equipment downhole. For instance, in removal operations, a cutting device is first lowered into the wellbore to cut the casing at a desired depth. After performing the cutting operation, the cutting device is returned to the surface. A spearing device is then lowered into the wellbore and engaged with the free end of the casing. Once the free end of the casing is engaged, an attempt is then made to recover the casing by pulling, or, in the case where jars are used, by a combination of pulling and jarring. If these attempts to remove the casing are unsuccessful, the spear assembly is removed from the wellbore and the cutting device is reattached to the tool string, lowered into the wellbore, and used to sever the casing at a point above the original cut. The pulling/jarring process is then repeated until the casing is recovered.

Even when casing is retrieved without performing a second cut of the casing, at least two trips are used to complete a cutting and retrieval operation on account of the utilization of separate cutting and extraction tools. When an extended length of casing is extracted, considerable rig time is also used to move the tools downhole to the site of the cut. Time and expense are therefore increased when multiple cuts are performed to retrieve the casing.

SUMMARY

According to some embodiments, a multi-stage flow device may include a housing, a sleeve, and at least two burst discs. The housing may have a first axial bore. The sleeve may be within the housing and may define a second axial bore. The sleeve may have a ball seat, as well as first and second flow passages through the sleeve. The first flow passage may be proximate the shoulder and offset from the second flow passage. Among the two burst discs, the first burst disc may be in fluid communication with the first flow passage, while the second burst disc may be in fluid communication with the second flow passage, and may have a higher burst pressure than the first burst disc.

In other aspects, some embodiments disclosed herein relate to a method of performing an operation in a wellbore. The method may include dropping a first drop ball into a tubular string and passing the first drop ball through a multi-stage flow device to a tool activation member. Using the drop ball and the tool activation member, a tool may be activated by restricting a flow of fluid through the multi-stage flow sub and the tool. An operation may be performed with the tool, and a pressure of the fluid within the tubular string may be increased to open a first flow passage in the multi-stage flow sub, thereby providing a passage for fluid to flow from the tubular string through the multi-stage flow sub.

In still other aspects, one or more embodiments disclosed herein relate to a system for cutting and removing casing from a wellbore. The system may include a cutting device, a spearing device, and a multi-stage flow sub. The cutting device may be on a tool string and configured to make at least one casing cut. The spearing device may be on the tool string and configured to engage and remove casing cut by the at least one cutting device. The multi-stage flow sub may be on the tool string and configured to provide control of pressure within an annulus of the wellbore during a spearing operation.

In another embodiment in accordance with embodiments of the present disclosure, a method for pulling casing from a wellbore may include dropping a first ball into a tool string and passing the first drop ball through a ball seat of a multi-stage flow sub to reach an activation mechanism of a spear. Pressure may be increased behind the first drop ball to a first pressure for activating the spear and engaging the spear with wellbore casing. The pressure may further be increased behind the first drop ball to a second pressure to open a first flow passage in the multi-stage flow sub, and fluid of the tubular string may be vented through the first flow passage into an annulus of the wellbore. A second drop ball may be dropped into the tubular string and passed to the ball seat. On the ball seat, the second drop ball may restrict flow of the fluid through the first flow passage. Pressure behind the second drop ball may be increased to a third pressure to decouple a sleeve from a housing of the multi-stage flow sub. Further increasing pressure behind the second drop ball to a fourth pressure may open a second flow passage in the multi-stage flow sub, and fluid may be vented through the second flow passage to the annulus of the wellbore. The tubular string, multi-stage flow sub, spear, and wellbore casing may further be pulled out of the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

FIGS. 12-1 to 12-3 are various views of an example ratchet mechanism of the spearing device of FIG. 9, according to one or more embodiments of the present disclosure.

DETAILED DESCRIPTION

According to some aspects, embodiments disclosed herein relate to a multi-stage flow sub. According to some embodiments of the present disclosure, a flow sub (e.g., a multi-stage flow sub) may be used during wellbore operations to provide for flow of fluid from a tool string to a wellbore annulus. The fluid flow provided by the flow sub may allow control of wellbore pressure during a tool operation and/or reducing or preventing of stripping of a wet string.

In the same or other aspects, embodiments disclosed herein may relate to methods and apparatuses for cutting and retrieving casing from a wellbore. A flow sub may be used during cutting and retrieval operations to provide for flow of fluid from a tool string to the wellbore annulus. The fluid flow provided by the flow sub may allow control of wellbore pressure during cutting and/or retrieval operations, and/or reducing or preventing of stripping of a wet string.

Figure 1:
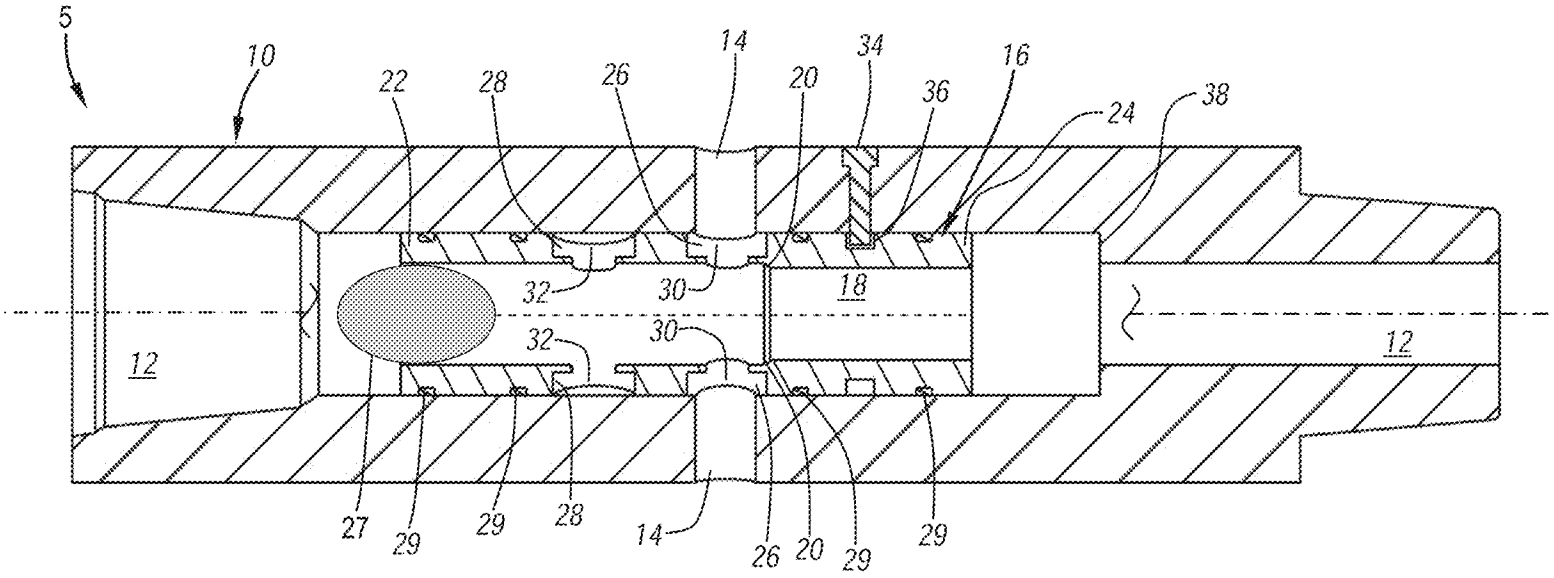
FIG. 1 illustrates a cross-sectional view of a multi-stage flow sub according to one or more embodiments of the present disclosure.
Figure 2:
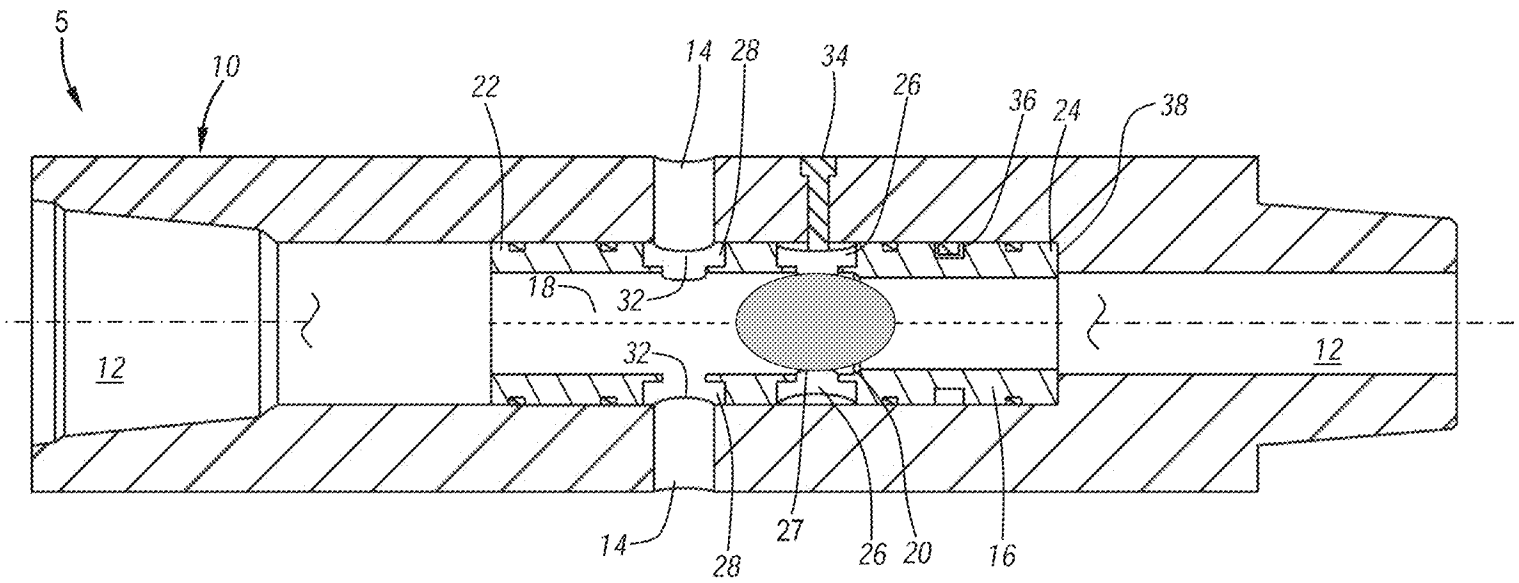
FIG. 2 illustrates a cross-sectional side view of the multi-stage flow sub of FIG. 1 following shearing of a shear pin, according to one or more embodiments of the present disclosure.

A multi-stage flow sub 5 according to some embodiments of the present disclosure is illustrated in FIGS. 1 and 2. The multi-stage flow sub 5 may include a housing 10 having an axial bore 12 and at least one flow passage 14. The axial bore 12 may extend fully or partially through the housing 10, although FIGS. 1 and 2 illustrate the axial bore 12 extending fully through the housing 10. In some embodiments, the flow passages 14 may extend radially from the axial bore 12 toward or to the exterior surface of the housing 10. As illustrated, the housing 10 may include multiple flow passages 14 (e.g., two flow passages 14). In some embodiments, the two flow passages 14 may be axially aligned and circumferentially offset by 180°. More or fewer flow passages 14 may also be used, and the flow passages 14 may be otherwise configured. For instance, two or more flow passages 14 may be axially offset, circumferentially offset by less than or greater than 180°, have unequal circumferential offsets between flow passages 14, have different shapes, extend perpendicularly to the axial bore 12, extend non-perpendicularly to the axial bore 12 (e.g., directed in an axial and radial direction), or be otherwise configured.

In some embodiments of a multi-stage flow sub 5, a sleeve 16 may be positioned within and/or coupled to the housing 10. The sleeve 16 may have an axial bore 18 extending fully or partially therethrough, and a shoulder 20 may be defined intermediate an uphole or proximal end 22 and a downhole or distal end 24 of the sleeve 16. In some embodiments, the shoulder 20 may be formed in a manner that results in the axial bore 18 having a variable width or diameter. For instance, as shown in FIGS. 1 and 2, the diameter of the axial bore 18 may be greater on the uphole or proximal side of the shoulder 20, than on the downhole or distal side of the shoulder 20. The shoulder 20 may be formed directly in the sleeve 16; however, in other embodiments the shoulder 20 may be formed as a separate component coupled to the sleeve 16 or the housing 10. Where provided, the shoulder 20 may provide an abrupt change to the width or diameter of the bore 18, although in other embodiments the change may be gradual (e.g., tapered, stepped, etc.).

In some embodiments, the sleeve 16 may include a first flow passage 26 extending partially or fully therethrough. In the illustrated embodiment, the first flow passage 26 is shown as being located proximate the shoulder 20, and extending radially outwardly from the axial bore 18. In some embodiments, the sleeve 16 may include a second flow passage 28 extending fully or partially therethrough. In FIGS. 1 and 2, for instance, a second flow passage 28 is shown, and may also extend radially outwardly from the bore 18. The second flow passage 28 is shown in this view as being uphole or proximal relative to the first flow passage 26. In other embodiments, the second flow passage 28 may be otherwise positioned or oriented relative to the first flow passage 26. For instance, the first and/or second flow passages 26, 28 may extend in an at least partially axial direction, or the first flow passages 26 may be uphole or proximal relative to the second flow passages 28.

In some embodiments, seals 29 may be positioned axially between the flow passages 26, 28 and the proximal and distal ends, 22, 24 of the sleeve 16, respectively. The seals 29 optionally are used to seal against fluid flow between the exterior surface of the sleeve 16 and an interior surface of the housing 10. The seals 29 may therefore restrict, and potentially prevent, fluid from flowing along at least a portion of the exterior surface of the sleeve 16.

In accordance with some embodiments, one or more flow restriction devices may be inside, coupled to, or otherwise located relative to the first and/or second flow passages 26, 28. For instance, a first burst disc 30 may be in the first flow passage 26 (or otherwise in fluid communication with the first flow passage 26), and a second burst disc 32 may be in the second flow passage 28 (or otherwise in fluid communication with the second flow passage 28). While illustrated and described with respect to burst discs, other devices known to those of skill in the art for restricting flow at a first pressure and allowing flow at a second pressure may be used. In some embodiments, the second burst disc 32 (or other flow restriction device) may have a higher burst pressure than the first burst disc 30 (or other flow restriction ndevice). For instance, the burst pressure of the first burst disc 30 may be up to 3,000 psi (21,700 kPa), and the burst pressure of the second burst disc 32 may be between 3,000 psi (21,700 kPa) and 4,000 psi (27,600 kPa). Such burst pressures are, however, merely illustrative and may be varied to be higher or lower in other embodiments.

The sleeve 16 may be movable within the housing 10 in at least some embodiments of the present disclosure. In such embodiments, the sleeve 16 may optionally slidable and/or rotate between positions. For instance, the sleeve 16 may slide or otherwise move between a first axial position, as illustrated in FIG. 1, and a second axial position, as illustrated in FIG. 2. In FIG. 1, the first axial position may correspond to a position where the first flow passage 26 in the sleeve 16 may be aligned with the flow passage 14 in the housing 10, while in FIG. 2 the second axial position may correspond to a position where the second flow passage 28 in the sleeve 16 may be aligned with the flow passage 14 in the housing 10.

The multi-stage flow sub 5 may also include a release mechanism for allowing the sleeve 16 to move relative to the housing 10. The release mechanism may, for instance, include a shear pin 34 in one or more embodiments of the present disclosure. The shear pin 34 (or multiple shear pins 34) may be at least partially within or coupled to the housing 10 and used to maintain the sleeve 16 at a first position (see FIG. 1). The shear pin 34 may have a shear strength that is in some embodiments selected such that the shear pin 34 shears or otherwise degrades when a predetermined axial force is applied. The axial force may be applied as a fluid pressure. In some embodiments, the fluid pressure used to shear the shear pin 24 or, or activate some other release mechanism, may be between the fluid pressure used to burst the first burst disc 30 and that used to burst the second burst disc 32. For instance, if the first burst disc 30 has a burst pressure of 3,000 psi (21,700 kPa) and if the second burst disc 32 has a burst pressure of 4,000 psi (27,600 kPa), the shear pin 34 may be rated to shear when a pressure on the sleeve 16 is between such pressures. For instance, the shear pin 34 may shear when the sleeve 16 is acted on by a fluid at a pressure between 3,250 psi (22,400 kPa) and 3,750 psi (25,900 kPa) (e.g., 3,500 psi (24,100 kPa)).

Once the shear pin 34 is sheared, the sleeve 16 may be movable within the axial bore 12. For instance, the sleeve 16 may be movable from the first axial position, as shown in FIG. 1, to the second axial position, as shown in FIG. 2. While a single shear pin 34 is illustrated, other embodiments may contemplate the use of multiple (e.g., two, three, or four or more) shear pins 34. For instance, four shear pins 34 optionally rated for the same shear force may be used to selectively couple the sleeve 16 to the housing 10. In other embodiments, a biasing member such as a spring may be used in addition to, or instead of, the shear pin 34 or other sacrificial element. For instance, the biasing member may exert a biasing force tending to push the sleeve 16 in an uphole or proximal direction. When hydraulic pressure is applied, the biasing force may be at least partially overcome to allow the sleeve 16 to move within the housing 10.

To align the first and second flow passages 14 and 26 in the first axial position, the location of the shear pin 34 (or other release mechanism) and a corresponding groove 36 or other attachment site in the sleeve 16 may be about the same axial distance from the flow passage 14. The shear pin 34 may also be positioned about the same axial distance from the first flow passage 26 as the groove 36. To align the flow passages 14 and 28 in the second axial position, the axial distance between the center of the second flow passage 28 and the center of the first flow passage 26 may be about the same as the distance between the distal end 24 of the sleeve 16 and a shoulder 38 on, or coupled to, the housing 10 when the sleeve 16 as measured when the sleeve 16 is in the first axial position. In some embodiments, the flow passages 14, 28 may be aligned when the axial distance between the groove 36 and the center of the first flow passage 26 is about the same as the axial distance between the first and second flow passages 26, 28.

In operation, movement of the sleeve 16 (including optional shearing of the shear pin 34, shear screw, or other sacrificial element) from the first axial position to the second axial position may be caused at least in part by using a flow restrictor such as a dart or drop ball 27. In the illustrated embodiment, the drop ball 27 may be dropped into a work string and may traverse the work string until reaching the housing 10. Once within the housing, the drop ball 27 may move partially through the bore 18, and to the shoulder 20. The drop ball 27, axial bore 12, and axial bore 18 may be sized to allow the drop ball 27 to reach the shoulder 20. For instance, the drop ball 27 may have a diameter that is less than the diameter of the axial bore 12, and less than the diameter of the portion of the axial bore 18 that is uphole or proximal relative to the shoulder 20. The drop ball 27 may have a diameter larger than a diameter of the axial bore 18 at the shoulder 20, such that the drop ball 27 will seat on, or otherwise engage, the shoulder 20. The shoulder 20 may therefore act as a ball seat.

The drop ball 27 may obstruct fluid flow through at least a portion of the axial bore 18, and potentially obstruct flow through the first flow passage 26. The first flow passage 26 may extend through the sleeve 16 such that the drop ball 27, once on the shoulder 20, may restrict flow to and through the first flow passage 26. Once fluid flow is restricted, the pressure of the fluid may be increased behind the drop ball 27, resulting in the application of a downward/downhole force on the drop ball 27, and hence a downward/downhole force on the sleeve 16 and the shear pin 34. Increasing fluid pressure may shear the shear pin 34, and allow downward movement of the sleeve 16 to the second axial position (see FIG. 2) where the sleeve 16 has landed on the shoulder 38.

Additional drop balls (not shown) may optionally be used to control operations of tools located downhole of the multi-stage flow sub 5. The inner diameter of the axial bore 18 may be selected such that one or more drop balls of a diameter less than the smallest inner diameter of the bore 18 (e.g., less than a diameter of the shoulder 20) may pass through the multi-stage flow sub 5. The one or more balls may be dropped through the multi-stage flow sub 5, and the drop ball 27 may later be dropped to activate the multi-stage flow sub 5. In particular, the drop ball 27 may have a diameter sufficient to land on the shoulder 20 and to restrict flow through the first flow passage 26 and/or through full or partial portions of the axial bores 12, 18.

In some embodiments, it may be desirable to activate the multi-stage flow sub 5 prior to activating or deactivating a tool downhole of the multi-stage flow sub 5. In such embodiments, the drop ball 27 used to land on the shoulder 20 may be an extrudable or other deformable drop ball. The shoulder 20 and the inner diameter of the distal end of the bore 18 may be configured to allow the extrudable drop ball to pass through the distal end of the axial bore 18 in the sleeve 16. For instance, sufficiently high pressure may cause the drop ball 27 to deform and be pushed through the shoulder 20 and the distal end 24 of the sleeve 16. The extrudable drop ball 27, once past the distal end 24 of the sleeve 16, may then proceed downhole through the axial bore 12 to activate or deactivate the desired tool.

Fluid flow may be used to push the extrudable drop ball through sleeve 16 without bursting the second burst disc 32. In such instances, the extrudable drop ball, such as a phenolic drop ball, may be extrudable through the sleeve 16 at a pressure intermediate that needed to shear the shear pin 34 and the burst pressure of the second burst disc 32. In some embodiments, an extrudable drop ball may be deformable so as to deform with sufficient build-up of pressure behind the drop ball 27. In other embodiments, the drop ball 27 may be dissolvable. The drop ball 27 may degrade and dissolve over time, thereby allowing a separate drop ball to later be passed through the multi-stage flow sub 5 to activate a separate tool.

A multi-stage flow sub may be used, according to embodiments herein, when performing one or more operations in a wellbore, such as with a tool string including one or more tools that may be above or below the multi-stage flow sub. Methods for performing operations in the wellbore with the multi-stage flow sub (e.g., multi-stage flow sub 5) may include dropping a first drop ball into a tubular string to pass through the multi-stage flow sub 5 to a tool. The drop ball may then be used to activate the tool, and the tool may be used to perform a respective operation within the wellbore.

When seated for activating the tool, the drop ball 27 may also restrict fluid flow through the tool string, including the multi-stage flow sub 5 and the tool. Once activation of the tool is complete, once a tool operation is complete, or once flow to a wellbore annulus on an exterior of the housing 10 is desired, the method may include increasing a pressure of the fluid within the tubular string to a pressure greater than a burst pressure of the burst disc 30, thereby opening a first flow passage 26 in the multi-stage flow sub 5. The flow passage 26 may be aligned with the flow passage 14, and may thus allow fluid to flow from the tubular string through the first flow passage 14.

In some embodiments, the fluid may flow from the tubular string, through the first passage 14, to an annulus between the tubular string and the wellbore. In such embodiments, the flow of fluid through first flow passage 26 and the flow passage 14 may be used for controlling a wellbore pressure via flow of fluid through the first flow passage 14 into the annulus between the tool string and the wellbore. In this manner, the tool operation may be conducted while maintaining a wellbore pressure set point. The fluid flow into the annulus may also allow for use of well control measures to be used, such as heavy weight muds and fluid loss control pills, in the event of a kick or release, or upon encountering a dry pocket during a downhole operation.

After completion of an operation, it may be desired to deactivate a tool below the multi-stage flow sub 5. Due, however, to the alignment of the flow passages 14 and 26 (e.g., before moving the sleeve 16), the fluid flow through the multi-stage flow sub 5 may not be conducive for deactivation of the tool. A method may therefore also include dropping a drop ball 27 (e.g., a second drop ball) into the tool string. The second drop ball 27 may then traverse downward through the tool string and land on the shoulder 20. Once landed, the second drop ball 27 may restrict flow of the fluid through the first flow passage 26 and the flow passage 14. The operation may then continue by increasing a pressure of the fluid within the tubular string to move the sleeve 16 of the multi-stage flow sub 5 from a first axial position, such as illustrated in FIG. 1, to a second axial position, such as illustrated in FIG. 2, thereby aligning a second flow passage 28 with the flow passage 14.

The second drop ball 27 may then be extruded through the multi-stage flow sub 5 toward another downhole tool, thereby activating or deactivating the downhole tool, as desired. Once the second drop ball 27 lands in the downhole tool, the flow of fluid through the multi-stage flow sub 5 and the tool may again be restricted. To again provide for control of wellbore annulus pressure and allow use of well control countermeasures, the method may further include increasing the pressure of the fluid within the tubular string to open the second flow passage 28 in the multi-stage flow sub 5, permitting flow of fluid through the second flow passages 28 and the flow passage 14 into the wellbore annulus. Opening the second flow passage 28 may optionally include bursting the second burst disc 32.

An illustrative method may further include tripping the tool string out of the wellbore. In some embodiments, the tool string may be withdrawn or tripped out while maintaining a fluid flow through the second flow passage 28 and the flow passage 14 of the multi-stage flow sub 5. Maintaining the second flow passage 28 open during the trip out may allow fluid to flow from the tubular string into the wellbore annulus, draining fluid as the tubular string is withdrawn from the wellbore. In this manner, the tool string may be disassembled joint-by-joint, where a joint being removed from the tubular string may be substantially free of drilling fluid, potentially containing residual fluids merely to the extent such fluids adhere to the internal and/or external surfaces of the joint. Multi-stage flow subs according to embodiments of the present disclosure may thus allow for a tool system or downhole tool assembly to be pulled out of the wellbore with a fluid bypass capability, thereby reducing or even preventing stripping of wet string by operators, improving the safety of the stripping operation, decreasing potential contact and release of drilling fluids or muds during the stripping operation, providing other features, or some combination of the foregoing.

In some embodiments, a multi-stage flow sub of the present disclosure may be used in conjunction with a hydraulic spear and/or a casing cutting tool, such as when performing a casing cutting and retrieval operation, performing slot recovery, backing-off a connection between downhole threaded components, or the like. Embodiments disclosed herein thus may also relate to a system for cutting and removing casing from a wellbore. An example system may include a cutting device on a tool string and configured to make at least one casing cut, a spearing device on the tool string and configured to engage casing cut by the at least one cutting device from the wellbore, and a multi-stage flow sub on the tool string and configured to provide control of pressure within an annulus of the wellbore during a spearing and/or pulling operation. The system may also include one or more of a jarring device, a stabilizer, a packer, a bypass valve, or a bumper sub, any of which may be above or below the multi-stage flow sub.

In another aspect, embodiments disclosed herein may relate to methods and apparatuses for cutting and retrieving casing from a wellbore. More specifically, methods and apparatuses disclosed herein may relate to removing casing from a wellbore by optionally making multiple casing cuts, and retrieving the casing joints in a slot recovery operation. In some embodiments, methods and apparatuses disclosed herein relate to making multiple casing cuts and/or retrieving multiple cut casing joints from a wellbore in a single trip.

The methods and apparatus disclosed herein may include downhole tool assembly designs that may be used in the cutting and/or removing of casing segments from a wellbore. In accordance with embodiments of the present disclosure, such operations—which may be referred to by those of ordinary skill in the art as slot recovery or casing pulling operations—may include the use of a downhole tool capable of cutting casing segments, engaging the cut segments, freeing the segments, and then removing the segments from the wellbore in a single trip. Multiple casing cuts in a single trip may increase the efficiency of a downhole trip. Methods for activating and/or deactivating multiple downhole tools will be discussed in greater detail herein, and a multi-stage flow sub described herein may be useful in activating and/or deactivating such downhole tools.

Figure 3:
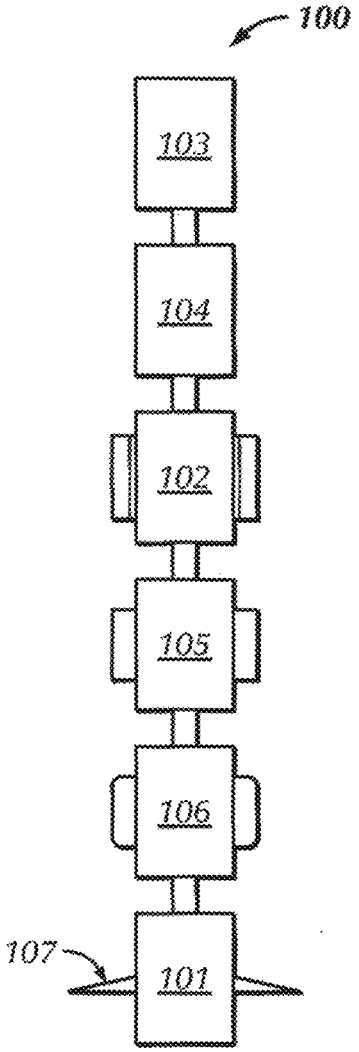
FIG. 3 schematically illustrates of a downhole tool assembly according to one or more embodiments of the present disclosure.

Referring to FIG. 3, a fishing tool assembly 100 is schematically illustrated according to some embodiments of the present disclosure. As shown, an example fishing tool assembly 100 may include some combination of a cutting device 101, a spearing device 102, a jarring device 103, a multi-stage flow sub 104, other components, or any combination of the foregoing. Generally, the cutting device 101 may be any type of cutting device capable of cutting cemented or uncemented casing, and may include cutting devices, pipe cutters, multi-cycle pipe cutters, wing-type casing cutters, section mills, and the like, which devices may be known in the art. The spearing device 102 may include a device capable of engaging cut casing, and examples of example spearing devices 102 are described in greater detail herein. The jarring device 103 may include various types of jarring devices, including those known in the art. The fishing tool assembly 100 may include one or more additional or other components that may facilitate a slot recovery, casing pulling, or other operation. Examples of other components may include, for example, a packer 105 and/or a stabilizer 106. Those of ordinary skill in the art will appreciate in view of the disclosure herein that, depending on the slot recovery, casing pulling, or other operation being performed, multiple cutting devices 101, spearing devices 102, multi-stage flow subs 104, packers 105, stabilizers 106, or other components (e.g., bumper subs, bypass valves, spring activated bypass valves, etc.), may be used.

Generally, as noted herein, a cutting device 101 may include any type of cutting device capable of cutting casing, and may include mills, pipe cutters, casing cutters, or other cutting devices known in the art. Such cutting devices may include a plurality of arms 107 that may be actuated to pivot, translate, or otherwise extend radially from the body of the cutting device 101 to engage casing within a wellbore. In some embodiments, cutting devices 101 may include a plurality of cutting elements, teeth, or inserts on the arms 107, such that upon actuation, the cutting elements contact the casing. Examples of cutting device actuation mechanisms may include, spring loaded knives, expandable arms and/or blades with cuttings elements thereon, and other cuttings devices known to those of ordinary skill in the art with the benefit of the disclosure herein.

As the tool string rotates (or as a downhole motor is used to rotate a drive shaft), the cutting device 101 may rotate and the cutting elements on the arms 107 may contact the casing and cut into the casing. The depth to which the arms 107 may cut through a thickness of the casing may be defined by the extension of the arms 107 and/or corresponding cutting elements. Thus, those of ordinary skill in the art will appreciate in view of the present disclosure that a depth of cut into the casing may be controlled by limiting the extension of the arms 107 and/or the protrusion from the arms 107 of associated cutting elements. Depending on the thickness of the casing being cut, it may be useful to limit the depth of the cut made by the cutting device 101. For example, the depth of the cut may be 0.1 inch (2.5 mm), 0.25 inch (6.4 mm), 1 inch (25.4 mm), or some other amount more than, less than, or equal to the casing thickness. In still other operations, it may be beneficial to have an alternate depth of cut, such as, for example, the thickness of the casing or some other specified depth for the specific operation. Such limits to the depth of cut may find application in operations where sequentially smaller casing segments are within the same region of the wellbore (e.g., where multiple casing strings are nested). Because the depth of cut may be limited, an operator may elect to cut into a first casing segment (i.e., an inner casing segment) potentially without cutting a second casing segment (i.e., an outer casing segment).

Figure 4:
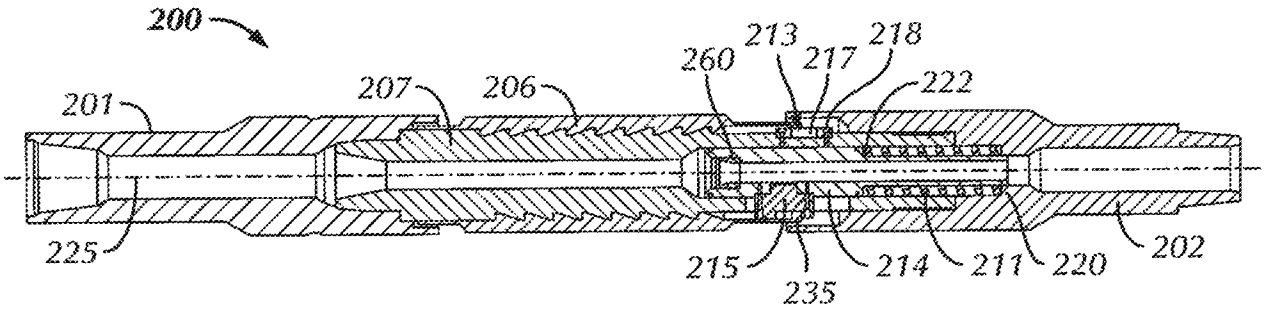
FIG. 4 is a cross-sectional view of a spearing device usable with a multi-stage flow sub, according to one or more embodiments of the present disclosure.
Figure 5:
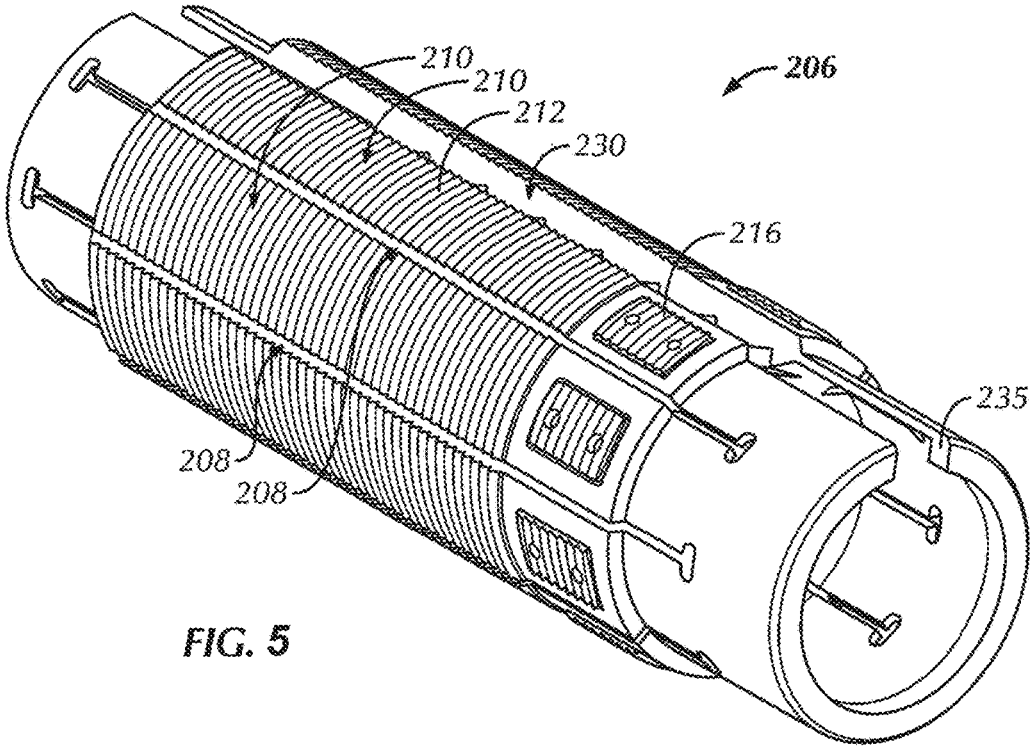
FIG. 5 is a perspective view of the spearing device of FIG. 3, according to one or more embodiments of the present disclosure.

Referring to FIGS. 4 and 5, a spearing device 200 is illustrated. The spearing device 200 may, in some embodiments, be used with the multi-stage flow subs described herein. The spearing device 200 may include a top sub 201 and a bottom sub 202 in some embodiments. A mandrel 207 may be threadingly coupled to the top sub 201 and the bottom sub 202, or otherwise coupled to remain stationary with respect to the top and bottom subs 201, 202 during operation of the spearing device 200.

In some embodiments, a grapple 206 may be positioned circumferentially around at least a portion of the mandrel 207. The grapple 206 may include one or more axial slots 208 defining separations between grapple members 210. At least a portion of the exterior surface of the grapple members 210 may include wickers 212, 216 (see FIG. 5) for engagement of the casing when the grapple members 210 are expanded. In some embodiments, the grapple members 210 include wickers 212 biased in an upward direction. Such a bias may be used, for example, to engage a casing and further aid in lifting the casing from the wellbore. Grapple members 210 may also include wickers biased in a downward direction, which grapple members 210 may minimize slippage of the grapple 206 relative to the casing during a jarring operation and/or aid with resetting of the jar, for example. Such a wicker design may allow the grapple members 210 to be engaged with the casing and also allow application of axial force in both uphole and downhole directions, as may be used in casing pulling, jarring, and jar resetting, or other operations.

As shown in FIG. 4, a portion of the outer surface of the mandrel 207 may be corrugated, have teeth, or otherwise be configured. Similarly, a portion of the inner surface of the grapple members 210 may be correspondingly corrugated, have teeth, or be otherwise configured. The respective corrugated or other mating surfaces may include ramps (non-helical) or buttress threads (helical), for example. The use of threads may provide for rotational jerking of the spearing device 200. The corrugated surfaces may provide for axial and/or rotational movement of the grapple 206 along the corrugated outer surface of the mandrel 207. Axial movement of the grapple 206 relative to mandrel 207 may result in expansion and contraction of the grapple members 210 due to the alternating heights of the corrugated surfaces. For instance, by moving the grapple 206 relative to the mandrel 207, the corrugated outer surface of the mandrel 207 may act as a cam to push or expand the corrugated surfaces of the grapple members 210 in a radially outward direction.

The design of the grapple 206 may depend on the type of corrugated or other surfaces used. For example, helical buttress threads may provide for use of a one-piece grapple 206, where, as illustrated in FIG. 5, a lengthwise axial slot 230 may allow the grapple 206 to flex when the grapple members 210 are expanded. The buttress threads may also allow for ease in assembly. Where the corrugated surfaces are ramps, a multi-piece grapple 206 may be used (e.g., two half-ring sections). In other embodiments, the corrugated surfaces may have a configuration other than a ramp or buttress thread.

A piston 214 may be movably coupled to the mandrel 207 and/or the bottom sub 202 (e.g., slidably located within the mandrel 207 and/or the bottom sub 202). The piston 214 may be operatively coupled to the grapple 206. For instance, activation dogs 215 may be used to couple the piston 214 to the grapple 206, and respective portions of the activation dogs 215 may push or pull on a shoulder 235 of the grapple 206. Movement of the piston 214 in an axial direction may thus provide for expansion and contraction of the grapple members 210. A biasing member (e.g., spring 211) may also be provided, operative with the piston 214, and may bias the grapple 206 toward a contracted or collapsed position. As illustrated in FIG. 4, the spring 211 may abut a shoulder 220 of bottom sub 202 and a shoulder 222 of the piston 214, and may be in a biased, uncompressed condition.

Expansion of the grapple members 210 may be provided by a hydraulic activation system. For example, fluid flow may be provided to the spearing device 200 via a through-bore 225. The fluid flow may pass through the top sub 201 and the mandrel 207 and enter a nozzle 260, resulting in the application of pressure to a top or uphole surface of the piston 214. The applied pressure may push the piston 214 downward or downhole, thereby compressing the spring 211, pulling the grapple 206 axially with respect to mandrel 207 via activation dogs 215, and expanding the grapple members 210 to engage an inner surface of casing to be removed or speared/engaged for other purposes. The engagement may provide a firm grip for the tool with the casing to facilitate, for example, the retrieval of the cut casing segment from the wellbore. When the hydraulic pressure is reduced, the spring 211 may decompress and move the grapple 206 upward, retracting the grapple members 210, and disengaging the grapple members 210 from the casing wall.

In other embodiments, the spring 211 may be positioned above the piston 214 and biased toward a compressed condition. In such embodiments, activation of the piston 214 may pull on the spring 211 and deactivation of the system may result in the spring compressing, pulling on the piston, and collapsing the grapple members.

The spearing device 200 may also include an anti-rotation locking system 213. In some embodiments, the anti-rotation locking system 213 may include one or more shear dogs 217, one or more shear screws 218, other components, or some combination of the foregoing. Where desired to avoid rotation of the grapple 206 relative to the mandrel 207, a shear dog 217 may be bolted or otherwise coupled to the mandrel 207 and located within a longitudinal slot 230 in the grapple 206. The shear dog 217 may incorporate an intentionally weakened face which can be sheared by application of right-hand (or in other embodiments left-hand) rotation of the mandrel 207, such as in the event of a grapple 206 "freeze" that cannot be released by conventional application of downward force. The anti-rotation locking system 213, when engaged, may restrict if not prevent the grapple 206 from rotating when fully engaged with the casing. In some instances, however, it may be desirable to rotate the grapple 206, such as to free the spearing device 200 from the casing or other instances as readily envisionable by one skilled in the art in view of the present disclosure. Thus, when disengaged (e.g., sheared), the anti-rotation locking system 213 may provide for rotation of the grapple 206, which may potentially be less than 360° degrees of permitted rotation. The ability to unlock the rotatability of the grapple 206 may be one optional feature provided during casing removal operations.

Referring now to FIGS. 6-15, spearing devices according to other embodiments of the present disclosure are illustrated and described. A spearing device 400 may include a top sub 401, a bottom sub 402, a spring 411, a piston 414, a mandrel 407, a grapple 406 (potentially including grapple members and wickers (not shown)), activation dogs 415, a throughbore 425, and an anti-rotation locking system 413, any of which may be similar or identical to those described with respect to FIGS. 4 and 5.

The spearing device 400 may further include a nozzle assembly 460 on a proximal end of the piston 414. In some embodiments, the nozzle assembly 460 may include a nozzle carrier 462 positioned at least partially axially above or uphole of the piston 414, a Bellville stack 464, and a nozzle 466. The spearing device 400 may also include a ratchet locking assembly 470 in the central bore of the top sub 401 and connected with the top sub 401 using threads or some other connection mechanism. In some embodiments, the locking assembly 470 may include one or more of an outer sleeve 472, an intermediate sleeve 474, an inner sleeve 476, an end cap 478, and a ratchet mechanism 480, among other components as will be described herein.

An upper end 477 of the inner sleeve 476, or a portion thereof, may be within the intermediate sleeve 474 and may include wickers, serrations, or other engaging elements (not illustrated) on an outer surface thereof. The inner sleeve 476 may extend axially through the mandrel 407, the lower end 479 (see FIG. 6) of the inner sleeve 476 being proximate the nozzle assembly 460.

The ratchet mechanism 480 may be between overlapping portions of the inner and intermediate sleeves 476, 474. The ratchet mechanism 480 may engage the wickers or other engaging elements of the inner sleeve 476, and may allow downward or downhole axial movement of the inner sleeve 476 while restricting, and potentially preventing, upward or uphole axial movement of the inner sleeve 476. The ratchet mechanism 480 may include a split ring 490 that includes inner ratchet teeth 492 (see FIGS. 12-1 and 12-2), retained by circumferential garter springs 491, for engaging the corresponding wickers 493 on the inner sleeve 476 (see FIG. 12-3). In some embodiments, the wickers 493 may be lengths of thread-like or ramped members that are tapered or inclined in a single direction. Thus, engagement between the ratchet rings 490 and the wickers 493 of the inner sleeve 476 may allow the inner sleeve 476 to move in a single direction with respect to the mandrel 407.

Figure 6:
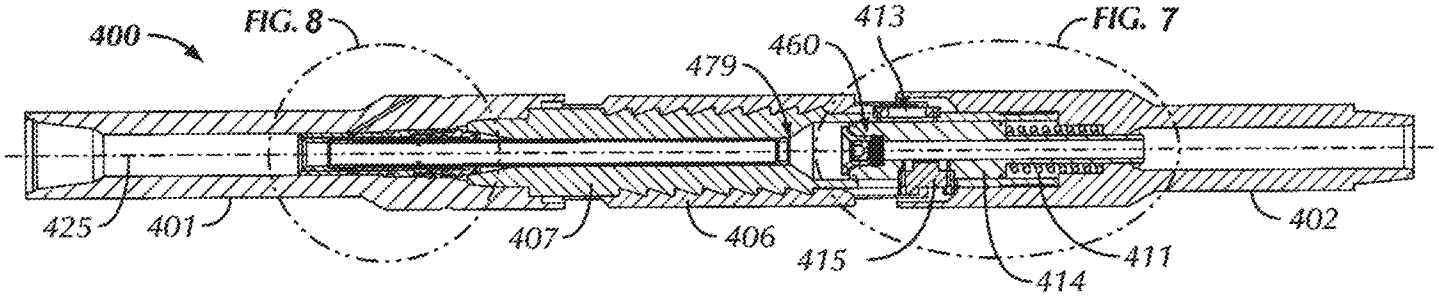
FIG. 6 is a cross-sectional view of another embodiment of a spearing device in an inactive state, according to one or more embodiments of the present disclosure.
Figure 7:
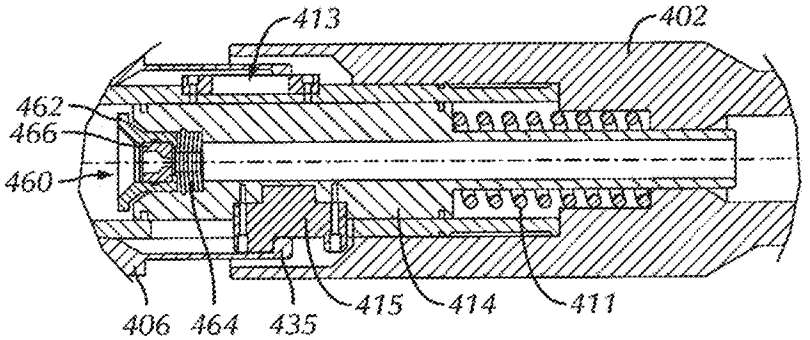
FIGS. 7 and 8 are enlarged views of portions of the spearing device of FIG. 6, according to one or more embodiments of the present disclosure.
Figure 8:
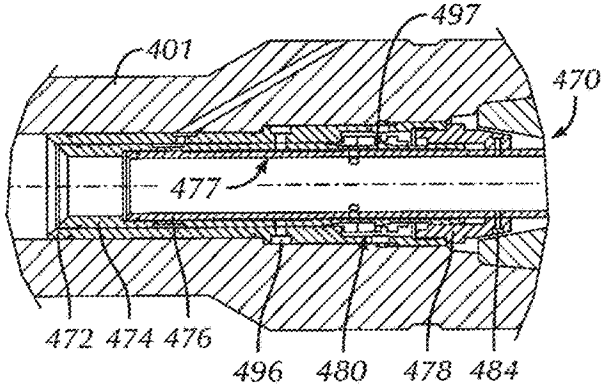
Figure 9:
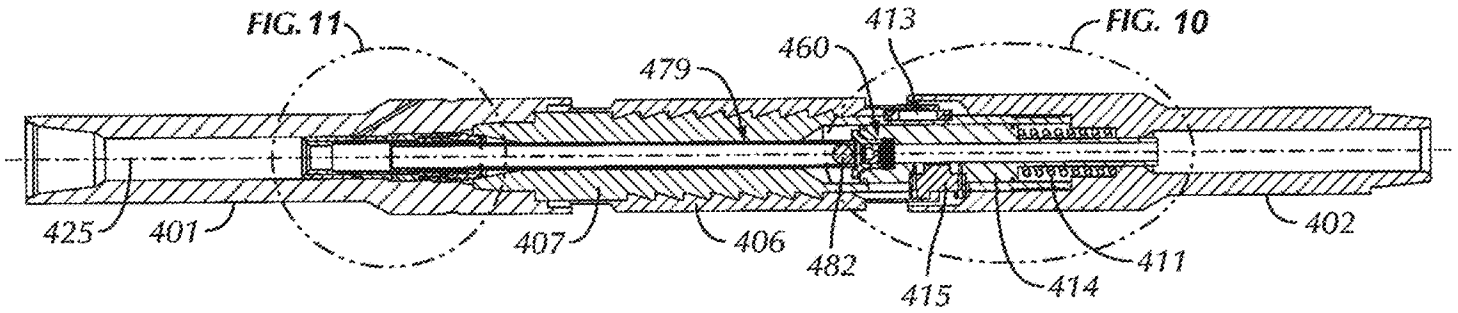
FIG. 9 is another cross-sectional view of the spearing device of FIG. 6, according to one or more embodiments of the present disclosure.
Figure 11:
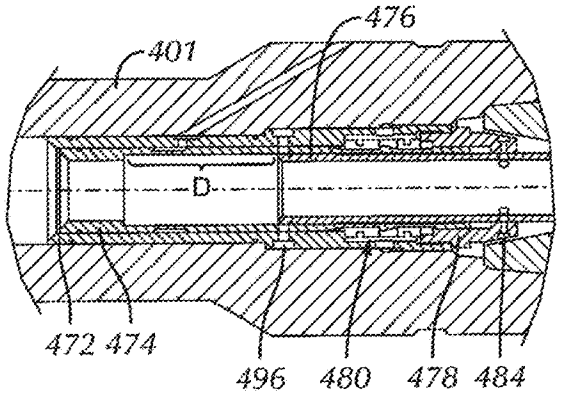
FIGS. 10 and 11 are enlarged views of portions of the spearing device of FIG. 9, according to one or more embodiments of the present disclosure.
Figure 10:
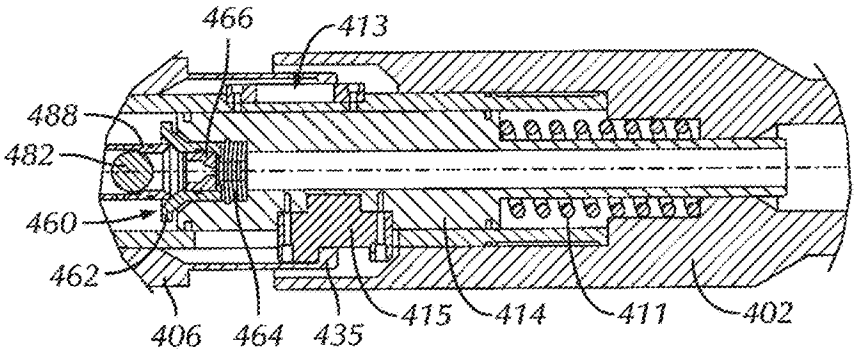
Figures 2, 12:
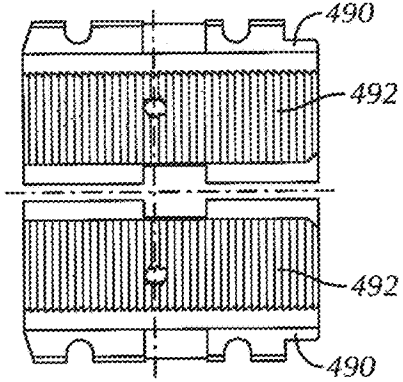
Figures 1, 12:
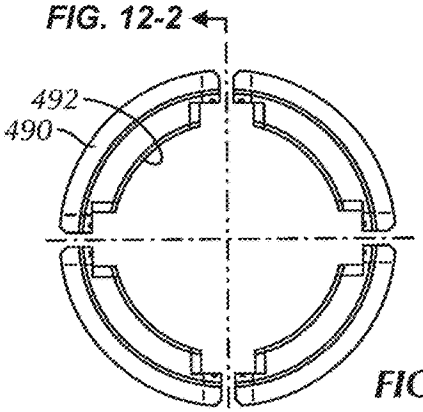
Figures 3, 12:
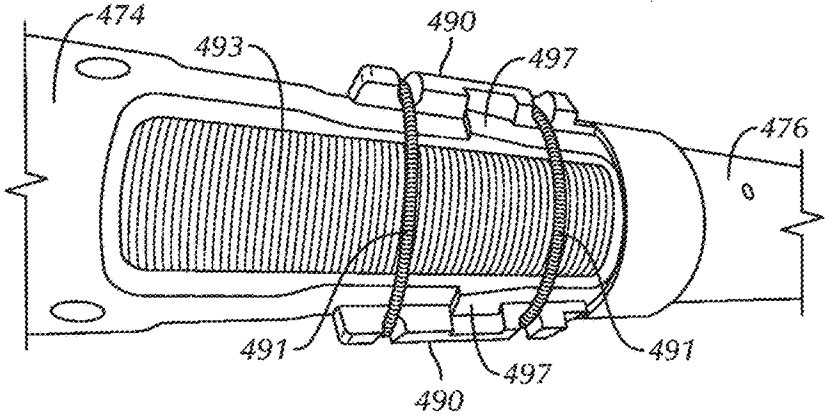

The illustrative spearing device 400 is shown FIGS. 6-8 in an inactive or non-activated state. When the spearing device 400 is to be used to engage, hold, or potentially retrieve a piece of casing (e.g., to retrieve the casing to the surface), it may be desired to engage the ratchet mechanism 480. This may be performed by bleeding pressure from the tool string and hence the bottom hole assembly, inserting a first drop ball 482 (i.e., a ratchet ball) at the surface and pumping this drop ball 482 through the tool string to the spearing device 400, as illustrated in FIGS. 9-11. In some embodiments, the drop ball 482 may pass through a multi-stage flow sub, including a multi-stage flow sub having one or more burst discs or other flow restriction members. Once the drop ball 482 has seated within the lower end of the inner sleeve 476, fluid pressure can be applied to the spearing device 400, resulting in the drop ball 482, and hence the ratchet mandrel (inner sleeve 476), being forced downwards or downhole a distance D. This applied force may result in the shearing of one or more ratchet mandrel shear screws 484 (see FIGS. 8 and 11). Prior to the first ball drop, the spearing device 400 may be hydraulically activated and deactivated as described above with respect to FIGS. 4 and 5, by shearing of the shear screws 484 as a result of the ball drop activating the ratchet mechanism 480. In some embodiments, using the drop ball 482 may allow the drop ball 482 to seat on the inner sleeve 476 and build up pressure to activate the ratchet mechanism 480. The pressure used to activate the ratchet mechanism 480 may be less than the pressure that would burst a burst disc or otherwise deactivate a flow restriction member of a multi-stage flow sub as described herein. For instance, if a lower burst pressure of a burst disc in the multi-stage flow sub is 3,000 psi (20,600 kPa), the ratchet mechanism 480 may be activated at up to 2,500 psi (17,200 kPa).

The downward movement of the drop ball 482 and the ratchet mandrel 476 may continue through the unidirectional wicker profile of the ratchet mechanism 480. The wicker profile of the ratchet mechanism may include retaining blocks or ratchet rings 490 retained by circumferential garter springs 491 (see FIGS. 12-1 to 12-3), for example, that allow radial movement sufficient to allow the ratchet mandrel 476 and corresponding ratchet retaining rings 490 with wicker profiles 492 to pass over each other and then snap back into a retention position after each wicker tooth length.

Movement of the inner sleeve 476 into contact with the nozzle carrier 462 may effectively block the nozzle 466, and thus restrict fluid flow through the spearing tool 400. Continued application of static pressure may push the drop ball 482, inner sleeve 476, and nozzle carrier 462 downward (i.e., downhole). Such movement may load the Bellville spring stack 464 and, in turn, directly mechanically push the piston 414 and activation dogs 415 into contact with a lower lip 435 of the grapple 406, drawing the lower lip 435 downward along the mandrel 407 and thereby radially expanding the grapple 406 into contact with the casing by using an activation process similar to that described herein. In addition to such directly applied mechanical force, fluid ports 488 above the position of the drop ball 482 in the inner sleeve 476 may allow fluid pressure to be applied to the upper face of the piston assembly (piston 414, nozzle carrier 462, activation dogs 415, etc.), thereby resulting in an effective activation force that matches, and possibly exceeds, that of the fluid set engagement described above with respect to FIGS. 4 and 5.

The Bellville stack 464 may be used to limit or prevent mechanical lockup of the ratchet mandrel 476 and the nozzle carrier 462 relative to the piston assembly (piston 414, activation dogs 415, etc.) and hence, through transmission, the grapple 406 and in turn the casing.

Figure 13:
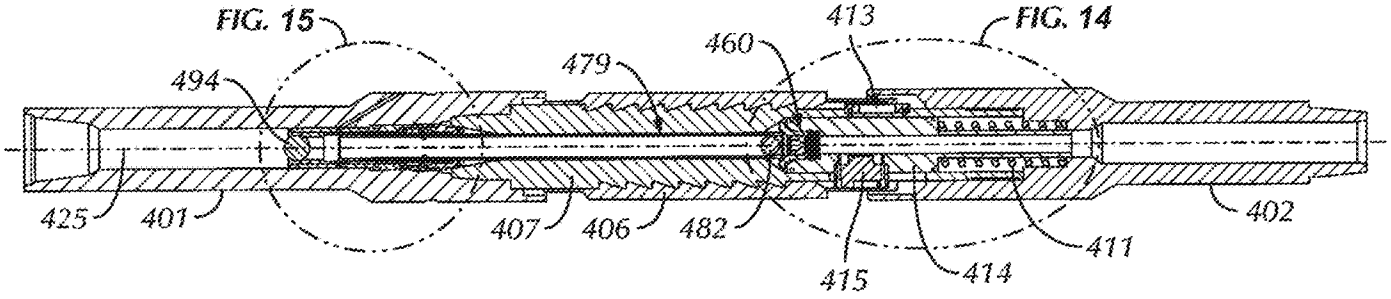
FIG. 13 is another cross-sectional view of the spearing device of FIG. 6 in an activated state, according to one or more embodiments of the present disclosure.
Figure 15:
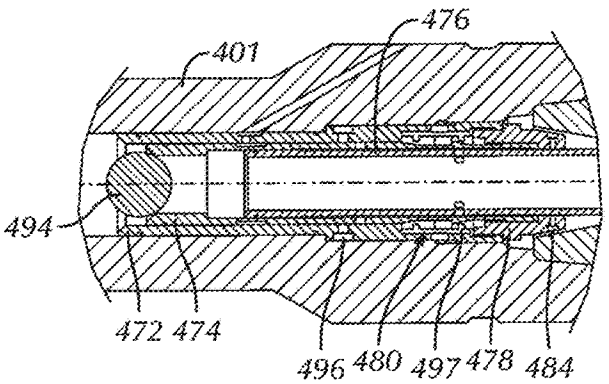
FIGS. 14 and 15 are enlarged views of portions of the spearing device of FIG. 13, according to one or more embodiments of the present disclosure.
Figure 14:
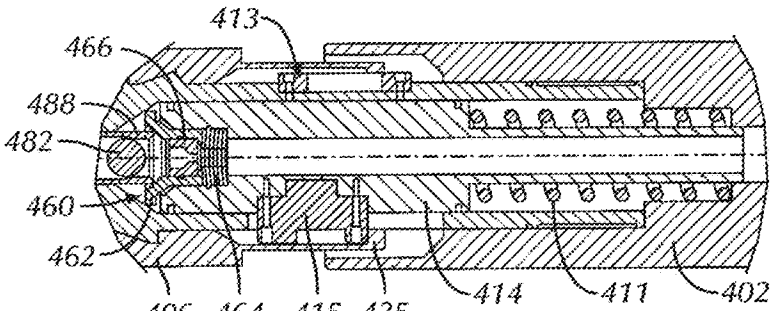

Referring now to FIGS. 13-15, when the spearing device 400 is to be released after activation with the ratchet mechanism as described herein (i.e., when deactivated), a second, potentially larger diameter drop ball 494 may be dropped into the tool string, used to move a sleeve of a multi-stage flow sub (e.g., sleeve 16 of FIGS. 1 and 2). Such a drop ball 494 may be extruded through the multi-stage flow sub, as described herein. When extruded, the drop ball 494 may be allowed to come into contact with the ratchet release sleeve (i.e., intermediate sleeve 474), as illustrated in FIG. 15.

Upon pressurization of the tool string and in turn application of fluid pressure to the drop ball 494, sufficient force may be applied to the ratchet release sleeve 474 to shear the ratchet release shear screws 496 (see FIGS. 8 and 15) coupling the outer sleeve 472 to the intermediate sleeve 474. Once this occurs, the ratchet release sleeve 474 may move in a downward or downhole direction, bringing a release wedge profile feature 497 into contact with the corresponding ratchet rings/retaining blocks 490 internal wedge profiles (not shown). In some embodiments, the release wedge profile feature may be integral with ratchet release sleeve 474.

Continued downward travel of the ratchet release sleeve 474 may force the ratchet rings 490 to move radially outwardly against the circumferential retaining garter springs 491. The distance travelled may allow clearance between the retaining rings 490 and the ratchet mandrel 476 wicker profiles. The resultant de-meshing of the wicker profile features may allow free upward movement of the inner sleeve 476, which may cause the spring, piston, and grapple to return to a relaxed position, thereby disengaging the grapple 406 from the casing, and thus releasing the casing.

Following deactivation of the ratchet mechanism, pressure in the tool string may again be increased. By increasing the pressure, one or more flow restriction devices may be deactivated (e.g., by bursting the burst disc(s) 32 of FIGS. 1 and 2), enabling the string to be vented, and fluid to be drained from an interior of the string above the multi-stage flow sub, enabling the dry string to be pulled out of the hole.

During casing recovery operations, varied configurations of bottomhole assemblies including the above-described components may be used. Referring back to FIG. 3, the operation of the downhole tool assembly 100 during casing recovery operations will be described in detail. Initially, the downhole tool assembly 100 may be positioned within a wellbore. The downhole tool assembly 100 may include a cutting device 101, a spearing device 102, a jarring device 103, and a multi-stage flow sub 104. As described above, the downhole tool assembly 100 may also include various other components, such as stabilizers 106, packers 105, other components, or some combination of the foregoing.

In some embodiments, the downhole tool assembly 100 may be positioned in a wellbore, and lowered to a portion of the wellbore where a casing cut is to be performed. When the downhole tool assembly 100 reaches the to-be-cut casing section, the cutting device 101 may be activated by, for example, radio frequency transmission, ball drop actuation, pressure actuation, pressure pulse from the surface to the tool (e.g., using measurement while drilling tools), or any other actuation method known to those of ordinary skill having the benefit of the present disclosure. Activation of the cutting device 101 may allow for a first casing segment to be cut. After the first casing segment is cut, the cutting device 101 may be deactivated, and the spearing device 102 may be activated. The spearing device 102 may be engaged with the cut casing segment, and the jarring device 103 may be activated to generate a jarring motion to free the first casing segment from a cement bond, from other casing, from the formation, or the like. Because the spearing device 102 may be engaged with the first casing segment, the downhole tool assembly 100 may be pulled up, and the casing segment may be removed from the wellbore.

In other embodiments, after the first casing segment is cut and the spearing device 102 is engaged with the cut casing segment, the cutting device 101 may be re-activated, and a second casing cut may be made. In certain embodiments, two casing cuts may be desired. For instance, upon jarring the casing segment, the second casing cut may allow the casing segment to be freed. To increase the precision of the casing cuts, one or more stabilizers 106 may be included in the downhole tool assembly 100 to centralize the cutting device 101 within the wellbore. By centralizing the cutting device 101, the individual cutters of the cutting device 101 may be controlled, such that a desired depth of cut may be maintained. Additionally, centralizing the cutting device 101 may decrease the wear on the individual cutters, thereby increasing the life of cutting device 101.

Figure 16:
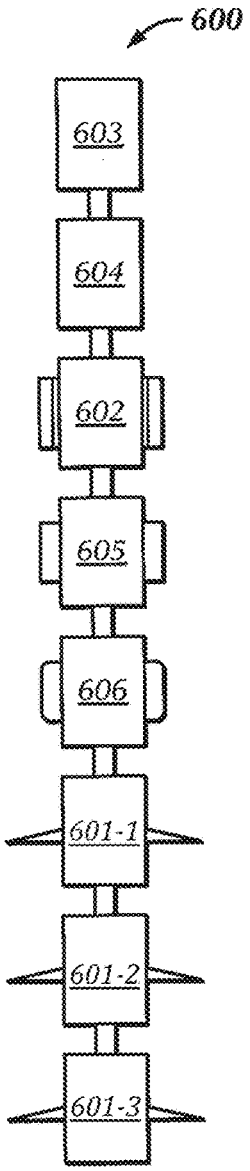
FIGS. 16 to 18 schematically illustrate various downhole tool assemblies according to embodiments of the present disclosure.

Referring now to FIG. 16, a downhole tool assembly 600 according to other embodiments of the present disclosure is shown. In the illustrated embodiment, the downhole tool assembly 600 may include multiple cutting devices 601-1, 601-2, 601-3, a spearing device 602, a jarring device 603, and a multi-stage flow sub 604. As described with respect to the embodiment of FIG. 3, the fishing tool assembly 600 may also include additional components, such as packers 605, stabilizers 606, MWD/LWD tools, other components, or some combination of the foregoing.

In some embodiments, the fishing tool assembly 600 may be tripped in a wellbore and activated similar to the activation of the downhole tool assembly 100 of FIG. 3. After a first casing segment is cut; however, the cutting device 601-1 may be deactivated and the fishing tool assembly 600 may either be raised or lowered into the wellbore to a different depth, and additional cuts may be made. For example, in some embodiments, the cutting device 601-1 may be activated and deactivated so as to make a number of cuts (e.g., two cuts, three cuts, or four or more cuts). After a number of cuts, the cutters of the cutting device 601-1 may be worn such that additional cuts may be difficult or inefficient. Rather than remove the fishing tool assembly 600 from the wellbore so that the cutters and/or cutting device 601-1 may be replaced; however, the cutting device 601-1 may be deactivated, and the cutting device 601-2 may be activated to allow additional cuts to be made. Those of ordinary skill in the art will appreciate in view of the disclosure herein that the process of deactivating one of the cutting devices 601-1, 601-2, or 601-3 and activating a different one of the cutting devices 601-1, 601-2, or 601-3 may occur in any order. For example, in certain embodiments, the lowest cutting device 601-3 may be activated first, while in other embodiments, the cutting device 601-1 or 601-2 may be activated first. The order of activation of cutting devices 601-1, 601-2, and 601-3 will depend on the casing cutting operation, as well as the depth of the casing segments within the wellbore. In some embodiments, activation of multiple ones of the cutting devices 601-1, 601-2, and 601-3 may occur about simultaneously, or a single one of the cutting devices 601-1, 601-2, and 601-3 may be activated and deactivated multiple times.

Multiple cutting devices 601-1, 601-2, and 601-3 (or multiple activations of one or more cutting devices 601-1, 601-2, and 601-3) may allow for multiple casing cuts to be made in a single trip of the tool string. Cutters of the cutting devices 601-1, 601-2, and 601-3 may, for instance, wear down after two to three cuts. As such, a tool string with a single set of cutting devices could be tripped out of the wellbore after two to three activations/cuts. The downhole tool assembly 600 may, however, be capable of making multiple cuts, such as twelve or more cuts, thereby decreasing the number of trips of the tool string for cutting casing segments from the wellbore. In other embodiments, the multiple cutting devices 601-1, 601-2, and 601-3 may serve as redundant cutting devices, such that if one of the cutting devices 601-1, 601-2, or 601-3 loses functionality or if the cutters of a first cutting device wear down prematurely, a second cutting device may be used. Those of ordinary skill in the art will appreciate in view of the present disclosure that depending on the casing cutting operation to be performed, the number of cutting devices 601-1, 601-2, and 601-3 may vary. As such, bottomhole assemblies having one, two, three, four, or more cutting devices are within the scope of the present disclosure.

Figure 17:
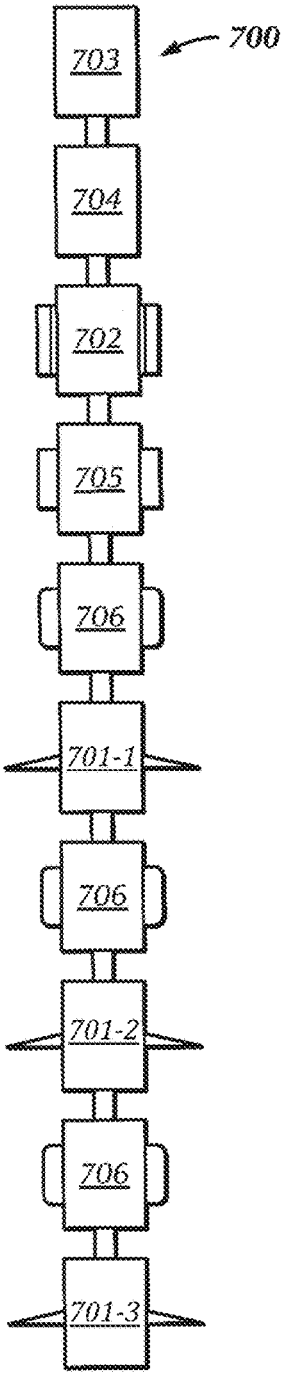

Referring to FIG. 17, a downhole tool assembly 700 is shown according to some embodiments of the present disclosure. The downhole tool assembly 700 may include multiple cutting devices 701-1, 701-2, and 701-3, a spearing device 702, a jarring device 703, and a multi-stage flow sub 704. The downhole tool assembly 700 may also include various additional or other components, such as one or more packers 705, and stabilizers 706, among other components.

In some embodiments, the configuration of multiple stabilizers 706 may allow for near cutting device centralization during activation of any of the cutting devices 701-1, 701-2, or 701-3. As illustrated, the stabilizers 706 may be located at least above each of cutting devices 701-1, 701-2, and 701-3. As such, as each of the cutting devices 701-1, 701-2, and 701-3 is activated, the tool string may be centralized in a location near the respective activated cutting device 701-1, 701-2, or 701-3. By increasing stabilization, and thus centralization of the tool string close to the individual cutting devices, the precision of cuts made by each cutting device 701 may be increased. Those of ordinary skill in the art will appreciate in view of the present disclosure that the spacing of the individual stabilizers 706 may vary based on various factors, including the type and/or size of casing being cut, and the parameters of the downhole tool assembly 700. By decreasing the distance between the cutting devices 701-1, 701-2, and 701-3 and the stabilizers 706, however, the centralization of the individual cutting devices 701-1, 701-2, and 701-3 may be increased. Additionally, in certain embodiments, stabilizers 706 may be positioned along the tool string both above and below an activated cutting device 701-1, 701-2, or 701-3.

Figure 18:
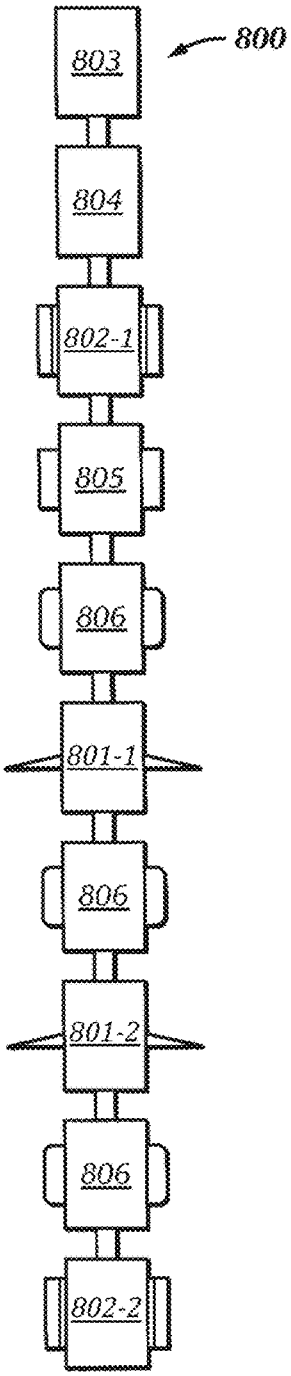

Referring to FIG. 18, a downhole tool assembly 800 according to some embodiments of the present disclosure is shown. In the illustrated embodiment, the downhole tool assembly 800 includes multiple cutting devices 801-1 and 801-2, multiple spearing devices 802-1 and 802-2, a jarring device 803, and a multi-stage flow sub 804. The downhole tool assembly 800 may also include various other or additional components, such as a packer 805, one or more stabilizers 806, other components, or a combination of the foregoing.

The downhole tool assembly 800 may include multiple spearing devices 802-1 and 802-2, thereby increasing the number of cut casing segments that may be removed from the wellbore in a single trip. The downhole tool assembly 800 may thus be used in a cutting operation wherein a cutting device 801-1 is activated, and a first casing segment is cut. The spearing device 802-1 may then be activated, thereby engaging the spearing device 802-1 with the first casing segment, and the jarring device 804 may optionally be activated to free the cut casing segment from the wellbore. Subsequently, a second cutting device 801-2 may be activated, and a second casing segment may be cut. The spearing device 802-2 may then be activated, so as to engage the cut casing segment. The jarring device 803 may then be reactivated, and the second casing segment may be freed from the wellbore. The above described method of cutting, spearing, and jarring may be repeated as many times as the cutters on the individual cutting devices 801-1, 801-2 may allow. Additionally, more than two cutting devices 801-1, 801-2 and/or spearing devices 802-1, 802-2 may be included in other embodiments. As such, multiple casing segments may be cut, speared, and removed from the wellbore in a single trip.

Those of ordinary skill in the art will appreciate that the order of operation of the individual components may be varied, without departing from the scope of the present disclosure. For example, in some embodiments, the cutting device 801-1 may be activated, and a first casing cut made. The cutting device 801-1 may then be deactivated, and the tool string may be lowered axially within the wellbore. The cutting device 801-1 may then be reactivated, and a second casing cut may be made. This process of making multiple casing cuts may be repeated for the life of the cutters on cutting device 801-1. After the desired number of casing cuts are made, the spearing device 802-1 may engage one or more of the cut casing segments, and the jarring device 804 may be activated to help free the casing cuts.

In other embodiments, after one or more casing cuts are made by the cutting device 801-1, the cutting device 801-2 may be activated, and a plurality of additional casing cuts may be made. Similar to the function of cutting device 801-1, the cutting device 801-2 may be activated and deactivated until the desired number of casing cuts has been made. After each desired casing cut has been made by the cutting devices 801-1 and 801-2, one or more of spearing devices 802-1 and 802-2 may be activated to engage the cut casing segments. In some embodiments, both spearing devices 802-1 and 802-2 may be activated (e.g., simultaneously or in sequence), while in other embodiments a single one of spearing devices 802-1 or 802-2 may be activated to allow for the removal of the cut casing segments from the wellbore. Those of ordinary skill in the art will appreciate in view of the disclosure herein that it may be desirable to solely engage the lowest axial spearing device (e.g., using spearing device 802-2), when removing the casing segments. Because the higher or uphole axial casing segments will be pulled up to the surface of the wellbore as the lowest axial casing segment is pulled upwardly, a single spearing device 802-2 may be used to remove multiple casing segments. In certain embodiments, however, it may be beneficial to engage multiple spearing devices 802 with the cut casing segments (e.g., to increase the contact area between the spearing device 802 and the casing being removed). By increasing the surface area of the contact between the spearing device 802 and the casing, more casing may be removed from the wellbore in a single trip, or casing may more efficiently be removed in a single trip.

Fishing tool assemblies as described herein may include a spearing device, or grapple, that is configured to engage drill pipe or casing. The spearing device may be internal to the cylindrical body of a cutting tool, or in other embodiments, may be a separate component of a fishing tool assembly. In embodiments where the spearing device is a separate component of a fishing tool assembly, the spearing device may be axially upward or uphole of a cutting tool, and may engage the drill pipe or casing before, during, or after the cutting operation. Thus, drill pipe, casing, or other downhole elements may be held in place during operation, and as the cutting tool assembly is removed from the wellbore, the cut section of the drill pipe may also be removed from the wellbore. In other embodiments, the spearing device may be axially downward or downhole of the cutting tool, or even both above and below the cutting tool.

Any of the embodiments described herein may allow for multiple casing segments to be removed from a wellbore in a single trip. The order of operation within specific embodiments of the present disclosure may vary according to the cutting, spearing, pulling, or other operations to be performed. For example, in certain embodiments, multiple casing cuts may be made, followed by a single spearing and/or jarring operation. In other embodiments, multiple casing cuts may be followed by multiple spearing and/or jarring operations. Accordingly, each casing cut may be made initially, followed by later spearing of a cut casing segment (e.g., the most downhole cut casing segment), jarring of one or more of the cut casing segments, and then removing the freed casing segments from the wellbore. Those of ordinary skill in the art will appreciate in view of the disclosure herein that each cut casing segment may be jarred loose separately. In other embodiments, it may be desired to cut a desired number of casing segments, spear the segments, and then cut additional segments. In such embodiments, multiple spearing devices may facilitate the cutting and removal of the cut casing segments from the wellbore.

Embodiments of the present disclosure may allow for casing segments to be cut, speared, and removed from a wellbore in a single trip of the tool string. By providing multiple cutting devices (e.g., mechanical cutting devices, abrasive cutting devices, laser cutting devices, etc.) that may be sequentially activated by the use of, for example, radio frequency transmission, sequential ball drop actuation, pressure pulse actuation, pressure thresholds, other activation mechanisms, or some combination of the foregoing, one or a plurality of casing segments may be cut, speared, and removed from the wellbore. Such activation may be remotely and/or selectively controlled from the rig floor or wellbore surface. By removing multiple casing segments in a single trip, valuable time may be saved in slot recovery, well abandonment, or other operations. Additionally, by decreasing the number of trips of the tool string to cut and recover casing segments, the cost of a corresponding downhole operation may be decreased.

The hydraulically actuated spears disclosed herein, such as illustrated in FIGS. 4 and 6, may provide for increased expansion of the grapple members, allowing an increased initial clearance, and facilitating insertion of the tool assembly within the casing. The greater expansion may also provide for use of an improved teeth (wickers) design, and for increased gripping forces, allowing a greater weight carrying capacity as compared to mechanically activated spearing devices, and facilitate removal of larger and/or more sections of casing in a single trip. For example, in the case of upward pulling, the force applied may be directly transmitted from the casing to the top sub 201 and in turn to the mandrel 207. This force may pull the mandrel 207 upwardly relative to the now "stuck" grapple 206, thereby increasing the radial expansion forces acting upon the grapple 206, and thus increasing the gripping force between the grapple wickers and the casing.

Embodiments disclosed herein may relate to a multi-stage flow sub. Illustrative multi-stage flow subs may be used to provide for increased wellbore pressure control when performing wellbore operations, such as casing cutting and retrieval operations. Multi-stage flow subs according to the present disclosure may also be used to ensure stripping of "dry" casing when a tool string is withdrawn from the wellbore. Such stripping may be realized, for example, when used with sequential ball drop operations associated with activating and deactivating a hydraulic spear, for example.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scopes of the disclosure and the appended claims. Each addition, deletion, and modification to the embodiments that falls within the meaning and scope of the claims is to be embraced by the claims. Components described as being attached, connected, secured, or otherwise coupled together may be formed separately and coupled directly or indirectly (e.g., via one or more intervening components) together using any mechanism described herein or known in the art. Components that are integrally formed together should also be considered to be coupled together.

In the claims, means-plus-function clauses are intended to cover the structures described herein as performing the recited function, including both structural equivalents and equivalent structures. Thus, although a nail and a screw may not be structural equivalents in that a nail employs a cylindrical surface to couple wooden parts together, whereas a screw employs a helical surface, in the environment of fastening wooden parts, a nail and a screw may be equivalent structures. It is the express intention of the applicant not to invoke functional claiming for any limitations of any of the claims herein, except for those in which the claim expressly uses the words 'means for' together with an associated function.

Certain embodiments and features may have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges may appear in one or more claims below. Any numerical value is "about" or "approximately" the indicated value, and take into account experimental error and variations that would be expected by a person having ordinary skill in the art.

What is claimed is:

1. A multi-stage flow sub, comprising a housing having a first axial bore;

a sleeve within the first axial bore of the housing, the sleeve defining a second axial bore, the sleeve further including:

a ball seat;

a first flow passage extending radially through a body of the sleeve, the first flow passage proximate to and uphole of the ball seat; and a second flow passage extending radially through the body of the sleeve, the second flow passage being axially offset from the first flow passage;

a first burst disc in fluid communication with the first flow passage, the first burst disc obstructing radial fluid flow through the first flow passage; and a second burst disc in fluid communication with the second flow passage, the second burst disc obstructing radial fluid flow through the second flow passage, the second burst disc further having a burst pressure higher than a burst pressure of the first burst disc.

2. The multi-stage flow sub of claim 1, the sleeve being movable between:

a first position in which the first flow passage is axially aligned with at least one flow passage of the housing; and a second position in which the second flow passage is axially aligned with the at least one flow passage of the housing.

3. The multi-stage flow sub of claim 2, further comprising:

a shear pin selectively coupling the sleeve to the housing at the first position.

4. The multi-stage flow sub of claim 3, the shear pin being having a shear force corresponding to a pressure intermediate burst pressures of the first and second burst discs, the sleeve being axially fixed within the housing when the shear pin is intact, and axially movable within the housing when the shear pin is sheared.

5. The multi-stage flow sub of claim 1, the first flow passage being blocked by a drop ball when the drop ball is on the ball seat.

6. The multi-stage flow sub of claim 5, the drop ball being deformable and passable through the ball seat at a pressure intermediate the burst pressure of the second burst disc and a pressure corresponding to a shear force of a shear pin coupling the sleeve to the housing.

7. A method, comprising:

dropping a first drop ball into a tubular string, and passing the first drop ball through a multi-stage flow sub to a tool activation member downhole of the multi-stage flow sub;

using the first drop ball and the tool activation member to activate a tool by restricting axial fluid flow through the multi-stage flow sub and the tool activation member;

performing an operation with the tool;

increasing a pressure of the fluid within the tubular string and thereby bursting at least one first burst disc and opening a first flow passage in the multi-stage flow sub, the open first flow passage providing for fluid flow from the tubular string radially through the multi-stage flow sub;

after bursting the at least one burst disc, dropping a second drop ball into the tubular string and landing the second drop ball on a ball seat of the multi-stage flow sub, the landed, second drop ball restricting axial fluid flow through the multi-stage flow sub and obstructing radial fluid flow through the open first flow passage; and increasing pressure of the fluid behind the second drop ball and thereby opening a second flow passage in the multi-stage flow sub, the open second flow passage providing for fluid flow from the tubular string radially through the multi-stage flow sub while fluid flow through the first flow passage is restricted.

8. The method of claim 7, wherein opening the first flow passage provides for fluid flow from the tubular string through the multi-stage flow sub to an annulus between the tubular string and the wellbore, the method further comprising:

controlling a wellbore pressure via flow of the fluid through the first flow passage.

9. The method of claim 8, wherein the tool is a hydraulic spear, the method further comprising:

cutting a first casing segment; and engaging the first casing segment with the hydraulic spear.

10. The method of claim 8, wherein activating the tool includes building pressure of the fluid behind a ratchet mechanism, the method further comprising:

building pressure of the fluid to deactivate the ratchet mechanism.

11. The method of claim 7, wherein opening the second flow passage includes:

moving a sleeve of the multi-stage flow sub from a first axial position to a second axial position.

12. The method of claim 11, further comprising:

using the second drop ball and the tool activation member to deactivate the tool.

13. The method of claim 7, wherein the first and second flow passages are in a sleeve of the multi-stage flow sub and wherein opening the second flow passage includes:

moving the sleeve from a first position in which the first flow passage is aligned with a flow passage in a housing of the multi-stage flow sub to a second position in which the second flow passage is aligned with the flow passage in the housing; and after moving the sleeve, bursting at least one second burst disc obstructing flow through the second flow passage.

14. The method of claim 7, further comprising:

controlling a wellbore pressure via flow of fluid through the second flow passage.

15. The method of claim 7, further comprising:

withdrawing the tubular string from the wellbore while maintaining a fluid flow through the second flow passage.

16. The method of claim 7, further comprising:

disassembling a tubular string joint of the tubular string, the tubular string joint being substantially free of drilling fluid during disassembly.

17. A system for cutting and removing casing from a wellbore, the system comprising:

a cutting device on a tool string and configured to make at least one casing cut;

a spearing device on the tool string and configured to engage and remove casing cut by the cutting device; and a multi-stage flow sub on the tool string and configured to provide control of pressure within an annulus of a wellbore during a spearing operation, the multi-stage flow sub including:

a housing defining a radial flow passage;

a sleeve within the housing, the sleeve defining an axial bore and including:

a first flow passage extending radially through the sleeve from the axial bore to an outer surface of the sleeve, the first flow passage proximate to and uphole of a ball seat;

a first burst disc obstructing radial fluid flow through the first flow passage, the first burst disc having a first burst pressure;

a second flow passage extending radially through the sleeve from the axial bore to the outer surface of the sleeve, the second flow passage being axially offset from the first flow passage; and a second burst disc obstructing radial fluid flow through the second fluid passage, the second burst disc having a second burst pressure higher than the first burst pressure; and a shear element axially fixing the sleeve to the housing with the first flow passage of the sleeve axially aligned with the radial flow passage of the housing, the shear element having a shear force corresponding to a fluid pressure between the first and second burst pressures.

18. The system of claim 17, further comprising at least one of a jarring device, a stabilizer, a packer, a bypass valve, or a bumper sub.

19. The system of claim 17, wherein:

the axial bore of the multi-stage flow sub is sized to allow a first drop ball dropped in the tool string to pass therethrough to the spearing device;

the spearing device includes an activation mechanism with a first ball seat and activates and engages the casing cut by the cutting device in response to a first pressure that builds behind the first drop ball when on the first ball seat;

the multi-stage flow sub includes a second ball seat sized to receive a second ball larger than the first ball, the second ball seat positioned to cause the second ball to obstruct radial flow through the first flow passage when the second ball is on the second ball seat and the shear element is not sheared;

the first flow passage of the multi-stage flow sub is open to the annulus of the wellbore when the first burst disc is burst, the shear element is not sheared, and the second ball is not on the second ball seat;

the sleeve of the multi-stage flow sub is decoupled from, and axially movable within, the housing of the multi-stage flow sub when the shear element has been sheared in the second flow passage of the multi-stage flow sub is open to the annulus of the wellbore when the first and second burst discs are burst, the shear element is sheared, and the second ball is on the second ball seat; and the spearing device is engaged with the casing while the first flow passage is open to the annulus of the wellbore and while the second flow passage is open to the annulus of the wellbore.

* * * * *